US006705018B2

(12) United States Patent
Guhse

(10) Patent No.: US 6,705,018 B2
(45) Date of Patent: Mar. 16, 2004

(54) MODIFIED CHALK LINE END WITH RETRACTABLE BLADE

(76) Inventor: Scott David Guhse, 578 Brightwood Rd., Millersville, MD (US) 21108

( * ) Notice: Subject to any disclaimer, the term of this patent is extended or adjusted under 35 U.S.C. 154(b) by 0 days.

(21) Appl. No.: 10/261,272

(22) Filed: Sep. 30, 2002

(65) Prior Publication Data

US 2003/0066199 A1 Apr. 10, 2003

Related U.S. Application Data

(60) Provisional application No. 60/326,348, filed on Oct. 1, 2001.

(51) Int. Cl.[7] ..... B44D 3/38

(52) U.S. Cl. ..... 33/414; 33/770; 33/758; 7/119

(58) Field of Search ..... 33/414, 409, 413, 33/756, 770, 768, 1 LE, 758, 755; 7/118, 119, 158, 163; 30/155, 382, 383

(56) References Cited

U.S. PATENT DOCUMENTS 166,099 A * 7/1875 Hastings ..... 7/119
3,276,490 A * 10/1966 Johansson ..... 30/123
3,404,456 A * 10/1968 Chilko ..... 30/155
4,561,189 A * 12/1985 Hirneise ..... 33/408
4,563,813 A * 1/1986 Fortenberry ..... 30/161
4,995,152 A * 2/1991 Steckler ..... 24/129 R
5,349,753 A * 9/1994 Gaffney ..... 30/155
5,822,867 A * 10/1998 Sakai ..... 30/298.4
5,873,174 A * 2/1999 Kraft ..... 33/758
6,082,014 A 7/2000 Beyers
6,138,370 A 10/2000 Rolfe

* cited by examiner

*Primary Examiner*—Diego Gutierrez
*Assistant Examiner*—Amy R. Cohen

(57) ABSTRACT

A chalk line end being comprised of two flat members (12*a* and 12*b*) set parallel at a slight distance from one another and bent and fused together along at least one shared edge to form a main body (10), containing a tear-shaped aperture (18) and towards one end a smaller aperture (22) which the chalk line (24) is tied through. A main tab formed by a section of at least one of said flat members bent essentially perpendicular to said main body. A blade (14), containing a similar tear-shaped aperture (18), is sandwiched between said two flat members of said main body, and pivotally attached (20) to said main body towards one end. A means for grasping (26) on said blade at the opposite end from the pivotal connection allows the user to grasp said blade between thumb and finger and rotate it out through a long open edge of said main body, until a fused section of said flat members stops it when the blade edge (30) is at an approximate ninety-degree angle to said main body. The user can then rotate the invention on the axis of said chalk line from its position in normal use, and hook it securely on a rounded or tapered edge engaging. A chalk line end of this type also allows the user to pop a line at an angle other than ninety-degrees off the edge of a sheet of material without the aid of a helper, nail or additional tools. The present invention, therefore, represents a significant and novel improvement over prior art chalk line ends.

22 Claims, 4 Drawing Sheets

MODIFIED CHALK LINE END WITH RETRACTABLE BLADE

CROSS REFERENCE TO RELATED APPLICATION

This application is entitled to the benefit of Provisional Patent Application Ser. No. 60/326,348, filed Oct. 1, 2001.

BACKGROUND

1. Field of the Invention

This invention relates to hand tools and, more specifically, to a chalk line device.

2. Description of Prior Art

In many fields, especially in most phases of building and construction, the chalk line can be used to strike a near perfect line on any uniformly flat surface. The chalk line, sometimes referred to as a "chalk box", has been around for some time with very few design changes or improvements. It consists of a length of string, a hollow housing containing a reel to collect this string attached to a crank outside of the housing, and a flat hooked tab that usually contains a tear-shaped aperture. For the purposes of this discussion, this hooked tab and the like will be referred to as a "chalk line end". The hollow housing is full of colored chalk, which coats the string when it is drawn out through a small hole in the housing.

To operate the chalk line system, the user first hooks the chalk line end over the edge of a sheet of material at a predetermined point, looking through the aperture to center the chalk line end on his mark. Then he unreels the string line as he stretches it across the material's surface, pulling it taut and holding it to the surface with one hand at a second predetermined point. With his other hand the user grasps the string line between thumb and finger a distance from where he is holding it to the surface, lifts it off the surface around six to eighteen inches and quickly releases it. The string line snaps back down onto the surface with some force, and when it is removed and re-reeled a straight, clear line of colored chalk is left on the material's surface connecting the two points. This process is often referred to as "popping a line".

The chalk line is a very useful tool in many fields, but in its present embodiment it is not without its limitations. For the purposes of this discussion, only limitations of the standard or "prior art" chalk line end, and not the entire chalk line system, will be disclosed in the interest of simplicity. The standard chalk line end can be used in the pre-described manner only if the line to be popped is at or very near a ninety-degree angle to the edge of the surface, and if the edge is clean and defined (not rounded, tapered or otherwise imperfect). If either of these conditions is not met, the standard chalk line end will almost always slip from the edge of the material.

The user can solve this problem in several ways. He can have a helper hold the end of his string line on the mark while he pulls it taut and pops the line. If no one is available to help, however, the user still has other options. The standard chalk line end has a tear-shaped aperture directly centered, with its narrowest end pointing toward the hooked tab of the chalk line end. The largest end of this aperture is easily wide enough to allow the head of a twelve or sixteen penny nail to pass through. This allows the user to drive a nail at an angle into the material, slide the chalk line end over the nail and pull the string line taut without the aid of a helper. Or, the user has the option of cutting a small notch into the material's edge with a knife or saw, then sliding the chalk line through the notch until it catches, thereby holding it on the mark.

However, all of these solutions are inconvenient and time-consuming, leading some to seek to design a more utilitarian chalk line end. Only two recent inventions attempting to accomplish this or anything similar could be found, disclosed in U.S. Pat. Nos. 6,082,014 to Beyers (2000) and 6,138,370 to Rolfe (2000). With no disrespect to the inventor intended, Beyers' chalk line end is large and bulky, as far as chalk line ends are concerned. Also, it bears little resemblance to its predecessors, thus losing the advantage of familiarity. And, while it can be used to pop lines off the surface edge at angles other than ninety degrees, it cannot be used in many of the ways that the standard chalk line end can be. This means that at some point the user would have to cut Beyers' chalk line end from the string line and replace it with a standard end to perform many tasks. In addition, Beyers' invention does little to address the issue of surface edge quality.

Rolfe's invention is not a chalk line end at all, but a instead a chalk line helper, as it is not attached to the string line in any way. However, it is included in the interest of thoroughness, as it serves as an anchor for a chalk line. Though it could be considered to have a similar purpose as the presently disclosed invention, there is nothing remotely similar in either their structure or method of operation. Not only is Rolfe's chalk line helper a separate entity from the chalk line itself, but the device must also be set and removed with a claw hammer or other such means, thereby involving the use other tools and thus making the process more complicated. In addition, the device's main goal is to facilitate the popping of parallel lines a particular distance apart (such as to define the area of a two-by-four wall), which it seems quite capable of doing well. So, in the end, Rolfe's chalk line helper has a significantly different main goal from that of the present invention, and is sufficiently different in structure as well.

SUMMARY

The invention, a modified chalk line end with retractable blade, in its preferred embodiment, consists of a flat, tapered, semi-rectangular main body made up of two flat members shaped somewhat like a standard chalk line end, bent and fused together along one of their corresponding long edges. At one end of the main body, one or both of the members are bent at least once to form a hooked tab that is essentially perpendicular to the main body. At the other end there is a small, round aperture through which the string line is threaded and tied off. There is another larger, tear-shaped aperture in the main body (in both members) with its narrowest end pointing toward the hooked tab, which allows the invention to be slid over the head of a driven nail and be held fast. This aperture also serves as a window through which the user can see and center the chalk line on the mark.

However, the invention has a new and significant feature. The two members that form the main body are set at a slight distance from each other, and between them there is a single-edged blade, attached to the main body towards one end by a pivotal connector, such as a rivet. This blade contains the same tear-shaped aperture as the main body, these apertures essentially aligning when the blade is completely inside the main body. It also has a pull tab or other device to allow the user to grasp and rotate the blade out from the main body somewhat like a pocketknife. The blade is stopped by a fused section of the main body members or a stop attached to the main body, when the blade edge is at an approximate ninety-degree angle to the long, open edge of the main body.

The normal position of use for a standard chalk line end (when it is used to engage a square, defined edge) is with the hooked tab pointing essentially downward and the main body flat on the top surface of the sheet of material. The present invention can be used in the previous manner, as well as in a new and novel way. If the user encounters a rounded or otherwise imperfect edge, or if the line to be popped is at an angle other than an approximate ninety-degree angle to the edge of the sheet of material, he now has a new option. First, the user must first swing the blade completely out from the main body, as described in the previous paragraph. Next, he rotates the blade around ninety degrees from the aforementioned normal position of use, using the chalk line as an axis. Then, instead of securing the invention to the edge using the hooked tab as before, the user engages the edge by the blade, which sets itself into the material when the chalk line is pulled back upon. He now can pop a line on a sheet with a rounded edge, or off the edge of a sheet at most any angle he chooses. In addition, using the blade to engage an edge works well on vertical surfaces, as well as with popping lines of significant length.

Objects and Advantages

The objectives and advantages of the present invention are as follows:

(a) to provide a chalk line end that enables a single user to pop lines with a chalk line at almost any angle off the edge of a board, or any other such sheet of material with a defined edge.

(b) to provide a chalk line end which will hold fast to curved, tapered or otherwise imperfect edges.

(c) to provide a chalk line end that will hold the chalk line on its mark when the line to popped extends a long way from its point of origin.

(d) to provide a chalk line end that can easily be used on vertical surfaces, as long as there is a defined edge to utilize.

(e) to provide a chalk line end having all of the aforementioned advantages, that can still perform all the duties of a standard chalk line end.

(f) to provide a chalk line end that is complex enough to justify offering it for sale independent of the rest of the chalk line system, and perhaps in packs of two or more.

(g) to provide a chalk line end with all of these qualities that is safe and easy to use, as well as being fairly inexpensive and easy to manufacture.

DRAWING FIGURES

REFERENCE NUMERALS

| | | | |
|---|---|---|---|
| 10 | main body | 12a | top member |
| 12b | bottom member | 14 | blade |
| 16 | main tab | 18 | tear-shaped aperture |
| 20 | pivotal connection (rivet) | 22 | small aperture |
| 24 | chalk line | 26 | pull tab (blade) |
| 28 | pull tab (main body) | 30 | blade edge |
| 32 | torsion spring | 34 | point of attachment, spring to blade |
| 36 | point of attachment, spring to main body | 38 | catch |
| 40 | textured surface | 42 | thumbnail/fingernail notch |

DESCRIPTION—FIGS. 1–6—PREFERRED EMBODIMENT

Figure 1:
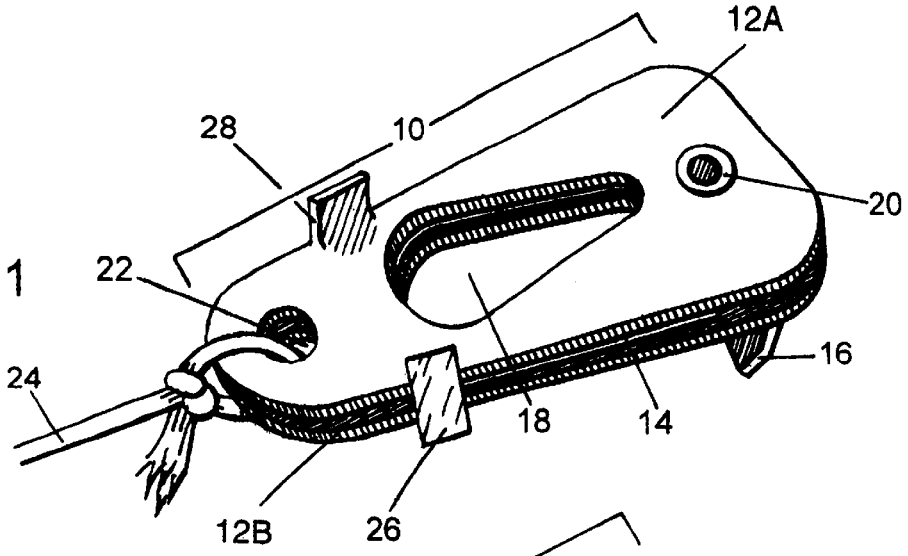
FIG. 1 is an oblique view of the preferred embodiment of the invention with the blade shown fully retracted into the main body.

FIGS. 1–6 show the structure of the preferred embodiment of a chalk line end of the present invention. FIG. 1 shows this preferred embodiment with the blade 14 fully retracted into the main body 10. Main body 10 consists of two flat members, the top member 12*a* and bottom member 12*b*. They are shaped somewhat like a standard chalk line end, but set apart from each other to accommodate the ease of movement of blade 14 loosely sandwiched between them. Top member 12*a* and bottom member 12*b* are bent and fused along at least one of their corresponding edges. They are pictured here as being formed from the same sheet of material, bent perpendicularly once and then again over on top of itself, so that one of the long edges of main body 10 is completely fused. A section of top member 12*a* (as pictured) or both top member 12*a* and bottom member 12*b* is bent at least once (shown here bent twice) to create a main tab 16 substantially perpendicular to main body 10. Top member 12*a* and bottom member 12*b* are fused together or at the very least directly adjacent along the edge created by main tab 16.

Figure 5:
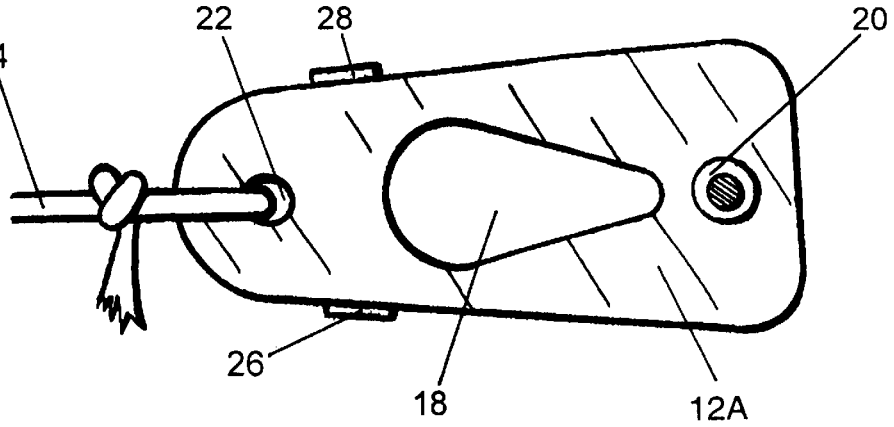
FIG. 5 is a view from above of the invention in its main embodiment.
Figure 6:
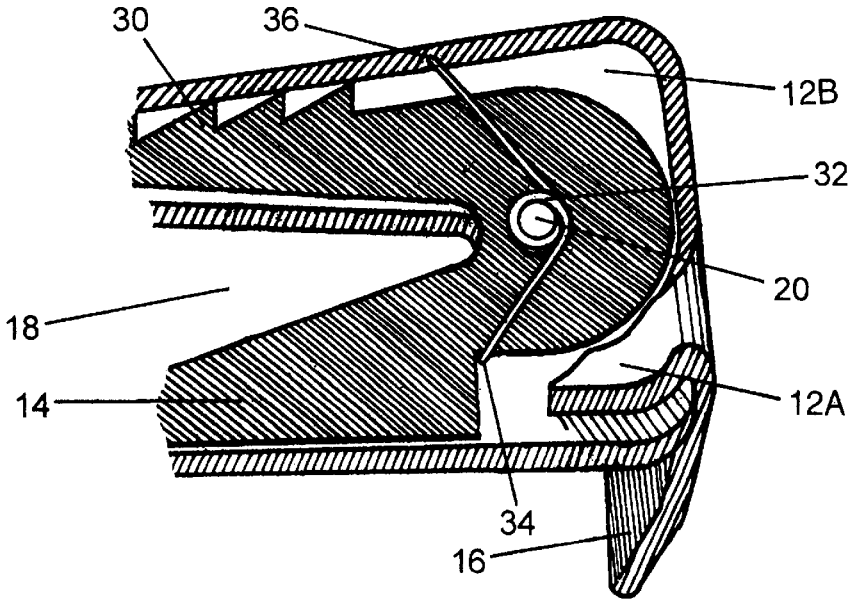
FIG. 6 is an enlarged view from above and beside of the invention with a large portion of the top member removed, making further visible the blade, pivotal connection and torsion spring.

In the preferred embodiment of the invention, top member 12*a* and bottom member 12*b* contain a tear-shaped aperture 18, as does blade 14, apertures 18 substantially aligning when blade 14 is drawn completely into main body 10 (see FIGS. 1, 5 and 6).

Blade 14 is coupled to main body towards one end by a pivotal connection 20, shown here as a rivet run through top member 12*a*, blade 14 itself and bottom member 12*b*, thereby connecting them all but letting blade 14 rotate freely upon it. Any similar means of pivotal connection may be used, however, this is simply the most obvious to present itself. The blade edge 30 is adjacent to the folded (or otherwise fused closed) long edge of main body 10; this closed edge of main body 10 serves to hold blade 14 therein on one side. Blade 14 is allowed to rotate freely out through the opposing long open edge of main body 10 on pivotal connection 20 until it is stopped when blade edge 30 is at an approximate ninety-degree angle to the long open edge of main body 10 (see FIG. 2). Pictured here, the rotation of blade 14 is stopped at this point by the junction of top member 12*a* and bottom member 12*b* where top member 12*a* is first bent to form main tab 16. Any similar means of stoppage could be employed here, however, as long as it accomplished the same basic end.

A pull tab 26 coupled to blade 14 is evident in FIGS. 1 and 2, defined here as a rectangular member attached perpendicularly to blade 14 which extends significantly past main body 10 both above and below. Pull tab 26 serves as a device by which the user can grasp between thumb and finger and rotate blade 14 out from main body 10. Another pull tab 28 is shown here attached to main body 10 at an opposing point from pull tab 26. Pull tab 28 helps the user grip main body 10 while he is rotating blade 14 out from inside it.

Figure 2:
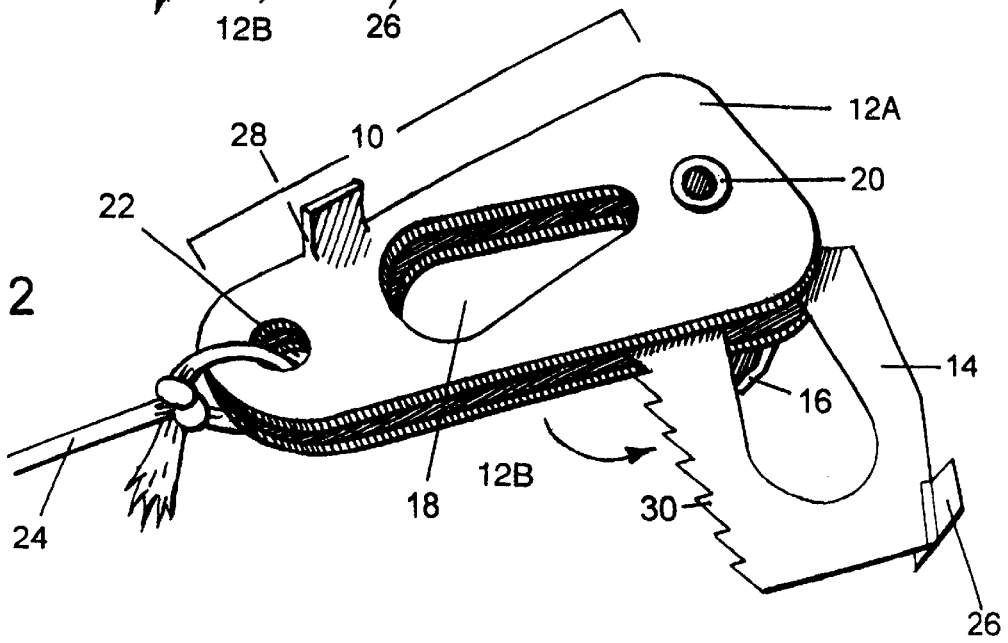
FIG. 2 is the same view of the invention as FIG. 1, but with the blade shown rotated out completely from the main body.
Figure 8A:
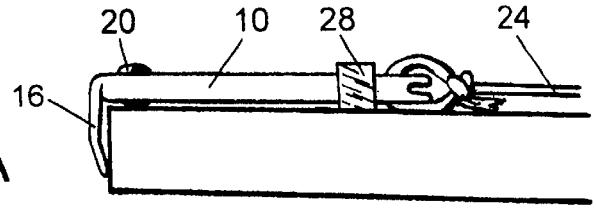
FIGS. 8A and 8B show the preferred embodiment of the being used in the same manner that a standard chalk line end would be.
Figure 8B:
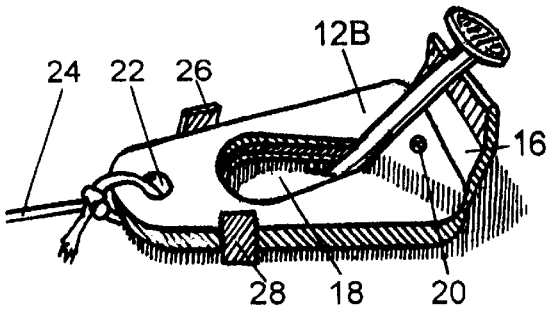

Blade edge 30 is shown in FIG. 2 and elsewhere within as being comprised of directional essentially triangular teeth, these teeth pointing back towards main body 10, in order to better sink themselves into the material's edge when the chalk line 24 is pulled back upon properly from the material's edge (see the arrows approximating the direction of pull in FIG. 8B). However, preliminary tests using a simple straight-edge razor blade were surprisingly successful, and as all the possible types of blade edge have not yet been tried, the final design of blade edge 30 must remain subject to further analysis and change.

Figure 3:
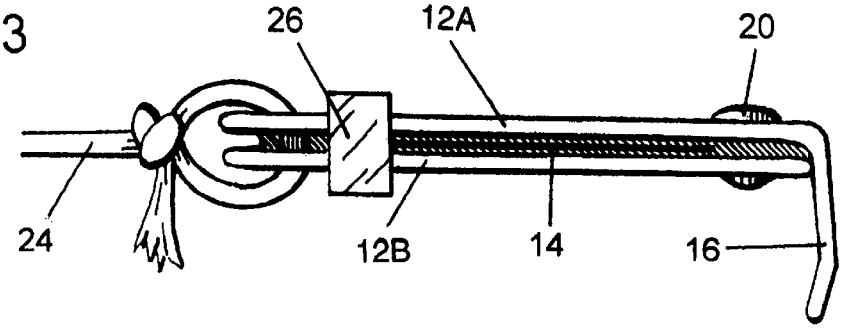
FIG. 3 is a side view of the invention in its preferred embodiment with the blade fully retracted, plainly showing the positioning of the main body members and blade.
Figure 4:
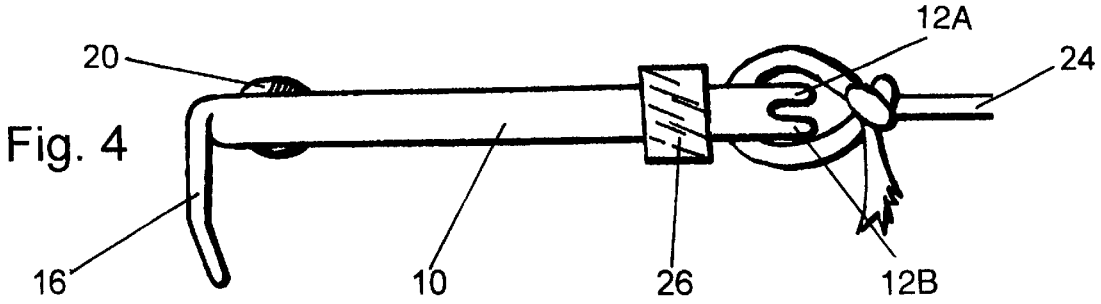
FIG. 4 is a view from the opposite side of the invention showing the bent and fused section of the members of the main body.

In FIG. 2, tear-shaped aperture 18 in blade 14 is most apparent as well. FIGS. 3 through 5 show the invention in its preferred embodiment from above and from both sides. Although no new elements can be discerned from these figures, they are included because they provide a better understanding of the parts of the invention already disclosed. FIG. 6 is an enlarged view of the invention from above and beside with most of top member 12*a* removed, making further evident the inner workings around pivotal connection 20. As can be plainly seen in this figure, blade 14 is narrowed and rounded at this end so it can rotate uninhibited, and shaped in a specific way so that blade 14 engages the means of stoppage at the proper point (when blade edge 30 is at an approximate ninety-degree angle to main body 10). A new feature can be seen in FIG. 6 as well: the torsion spring 32.

It has been asserted by the inventor from the conception of the invention that it should include a means for automatically retracting blade 14 into main body 10 when tension is released from chalk line 24. It has been demonstrated in testing that a chalk line end of the type being presently disclosed can be used in the safest and easiest manner if it has such a device. Torsion spring 32 will automatically retract blade 14 into main body 10 when blade edge 30 is relieved of tension and pull significantly (as when the user eases tension on chalk line 24) if it is installed in the invention as pictured here. Torsion spring 32 is shown centered around pivotal connection 20, and coupled to main body 10 at point 36 and to blade 14 at point 34 in a way that it is under some torsion when blade 14 is rotated completely inside main body 10, at least enough torsion to hold blade 14 therein. Torsion spring 32 is ideally under the most torsion when blade 14 is rotated to the fullest extent possible out from main body 10, as it must possess enough torque at this point to draw blade 14 completely into main body 10. As it is an issue of safety in the end, and it is felt not enough testing has been done to come to a final conclusion, torsion spring 32 or any device like it must remain an optional feature of the invention in its preferred embodiment.

FIGS. 7A–7C—ALTERNATIVE EMBODIMENTS

Figure 7A:
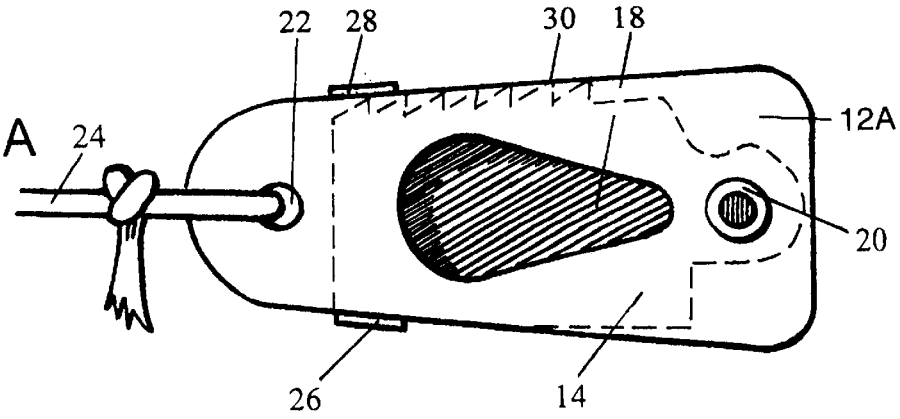
FIGS. 7A to 7C are views from above of the invention in alternative embodiments.
Figure 7B:
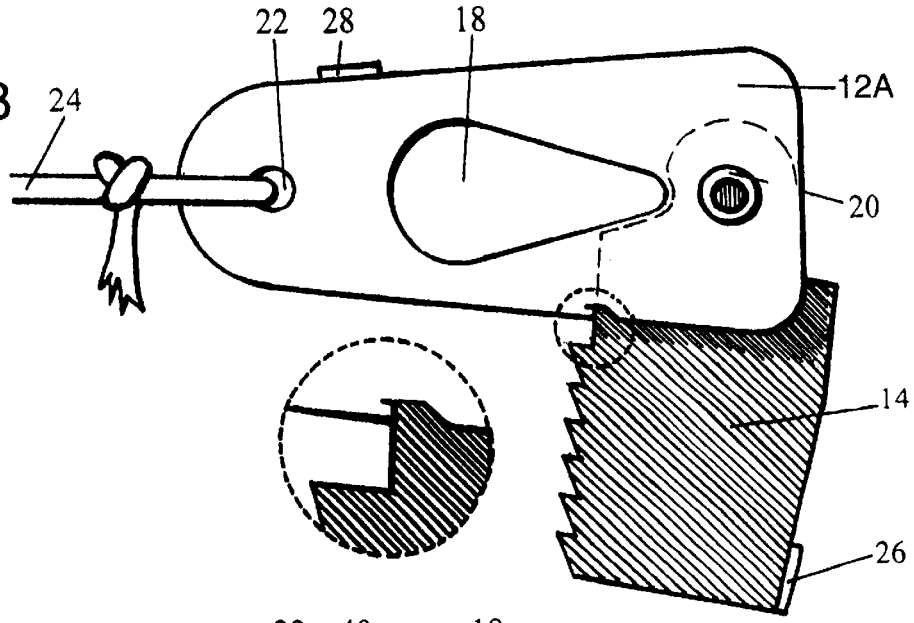

There are additional embodiments of the invention that must be disclosed, and alternative and additional features to consider. For instance, if it proves overly difficult for any reason to produce blade 14 with aperture 18 in it, or a blade 14 isn't left strong enough when the part of it occupying aperture 18 is removed, an alternative embodiment of the invention is illustrated in FIGS. 7A and 7B in which blade 14 is without aperture 18. In FIG. 7A blade 14 is pictured drawn completely into main body 10. The outline of blade 14, which would normally be hidden from view, is represented here with a dashed line. It is evident from this figure that top member 12*a* contains aperture 18 while blade 14 does not, and is clear from FIG. 7B that bottom member 12*b* contains aperture 18 as well.

FIGS. 7A and 7B also illustrate the singular feature of this embodiment: blade 14 is shaped specifically so that it clears aperture 18 completely when it is rotated out at least in part from main body 10. If the invention in this embodiment possesses optional torsion spring 32, a catch 38 must be employed to grab and hold blade 14 when it clears aperture 18. Catch 38 is pictured in FIG. 7B in a circled and enlarged section, shown here as a simple notch cut into the edge of top member 12*a*, the small flange of metal created by this cut bent slightly to allow blade 14 to slide into the notch easily. Obviously, if the invention in this embodiment does not possess torsion spring 32 or any device like it, it follows that catch 38 is not needed.

Figure 7C:
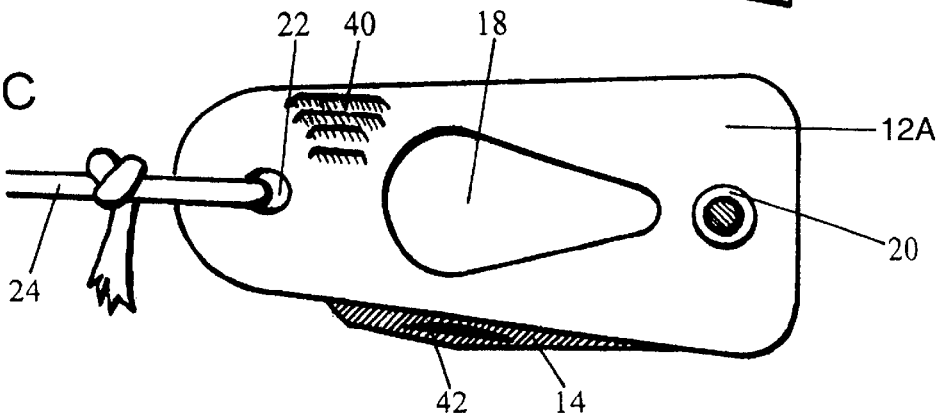

In FIG. 7C some alternate features are illustrated, more specifically some means for grasping blade 14 and main body 10 to replace pull tab 26 and pull tab 28 described previously in the main embodiment of the invention. Textured surface 40 is pictured here as a series of raised lines on the surface of top member 12*a* to help the user to grasp main body 10 firmly. Textured surface 40 could be comprised of many things: a series of raised bumps or notches carved into the surface, or a gripping material could be somehow attached to top member 12*a*. Textured surface 40 could also be applied to the surface of bottom member 12*b* as well, for optimum grip.

FIG. 7C also illustrates a substitute for pull tab 26 located on blade 14 in the main embodiment of the present invention. Here, blade 14 is pictured with a portion left exposed at the open long edge of main body 10. A thumbnail/fingernail notch 42 is present on the surface of blade 14 left exposed, being etched to a significant depth and shaped though as to properly engage the thumbnail or fingernail of the user allowing him to grasp blade 14 firmly. A similar but opposing notch 38 could also replace textured surface 42 on main body 10.

As there are many possible alternatives to pull tab 26 and pull tab 28, they may be thought of from now on by the broader phrase "means for grasping between thumb and finger". Also, the embodiments of these alternatives should not be limited to what has been illustrated in the drawing figures or disclosed in the description to this point, as the proper large-scale tests needed to make a final decision on what is most feasible and ergonomic have not been completed.

There are also other alternative embodiments of the entire invention which must be discussed, as they are among the ways one might try to "design around" this patent. The most obvious way to do this would be to make a chalk line of the present invention leaving out one part, preferably a part not crucial to the most basic operation of the invention. For instance, a chalk line end of the present invention could be made without main tab 16, and the user would simply have to employ blade 14 for every line popped from the edge of a sheet of material, regardless of whether it is perpendicular to the surface edge or not (see OPERATION). Another example of this technique might be to manufacture a chalk line end of this type that lacks aperture 18. If the user wanted to use a nail as an anchor to aid in popping a line, or to suspend the housing of the chalk line system from a nail for use as a plumb bob, he would simply have to wrap chalk line 24 around the nail to secure it. Also, a chalk line end without aperture 18 would lack a window through which the user can see and center the chalk line end on the mark.

It is clear from both of these examples that alternative embodiments such as these are clearly inferior to the preferred embodiment and the first alternative embodiment disclosed in this section, so they are not depicted in the drawings. However, they are important to the protection of this patent, and help to shape the phrasing of the claims, therefore they must be addressed here within the specification.

ADVANTAGES

From the description of structure above and the previous summary describing its use, a number of advantages of the present invention become evident:

(a) The invention in its preferred embodiment resembles very much the standard chalk line end, yet works in novel and unique ways.

(b) Carpenters and tradesmen and women are often reluctant to use tools that are awkward, overly complex or that differ too much from the industry standard. The present invention, in its preferred embodiment, is both simple in design and simple in use, and can perform all the duties of its predecessors.

(c) This invention will be particularly useful in the field of carpentry and, more specifically, in marking roof plywood to be cut. Hips and valleys in roof layouts make it necessary for carpenters to cut plywood at various angles to the edge of the sheet, and the main object of the present invention is to allow the user to pop lines of the type necessary to cut these angled sheets without the aid of a helper, nail or any additional tool. This alone represents a great advantage of the present invention over prior art.

(d) The invention in its preferred embodiment will also hold fast to imperfect edges, can be used on vertical surfaces and over long distances, as well as in all of the ways mentioned previously. It represents a unique and significant improvement in the field of hand tools.

(e) The presently disclosed invention is in a very narrow market, the field of chalk line systems, which has seen few improvements or changes in many years, and may present investors and manufacturers with the rare opportunity to, in effect, "corner a market".

OPERATION—FIGS. 7A–9B

In part, the manner of using the chalk line end with retractable blade is identical to that of the standard chalk line end. If the user desires to pop a line on a sheet of material that is at an approximate ninety-degree angle to the edge of the sheet, he simply hooks the invention over the edge by main tab 16, as in FIG. 8A, and the chalk line is held fast. Similarly, as illustrated in FIG. 8B, if the user desires to use a nail as the anchor for the invention, as when there is no edge for it to engage, or the housing of the chalk line system is to be suspended from a nail for use as a plum bob, a nail is first driven at the proper angle partway into the material. The user then slips the invention over the nail by means of tear-shaped aperture 18.

If the alternative embodiment illustrated in FIGS. 7A and 7B is employed, the latter process is somewhat different. First, blade 14 must be rotated out from main body 10 until it clears aperture 18 in top member 12*a* and bottom member 12*b*. If torsion spring 32 or a device like it is included in the invention in this embodiment, the blade must engage catch 38, illustrated in FIG. 7B as a notch cut into top member 12*a* creating a small flange that is then bent slightly to better receive blade 14. The user accomplishes the latter by simply rotating blade 14 out from main body 10 until it is past catch 38, then releasing it a bit with pressure towards top member 12*a*, thereby guiding blade 14 into catch 38. Then tear-shaped aperture 18 can then be utilized, as shown in FIG. 8B. To disengage blade 14 from catch 38, the user swings blade 14 out from main body 10 a little further until it clears catch 38, then releases it.

Figure 9A:
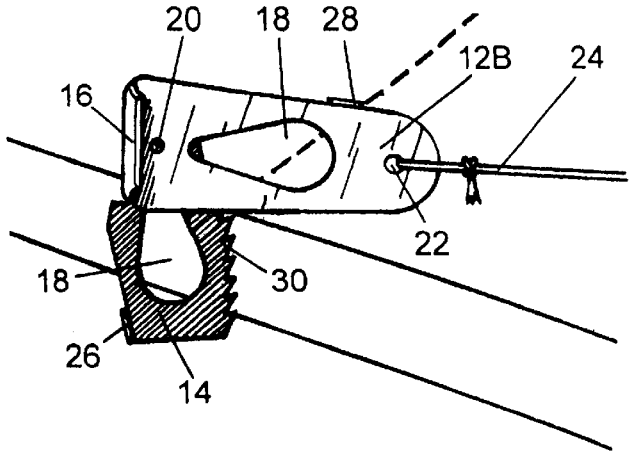
FIG. 9A shows the invention in its preferred embodiment being used to pop a line at an angle other than ninety degrees off the surface edge.
Figure 9B:
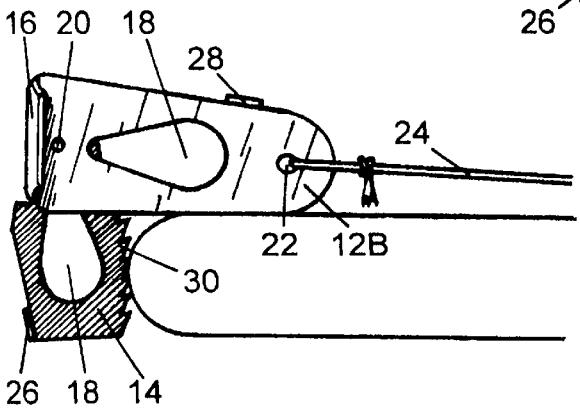
FIG. 9B shows the invention in its preferred embodiment being used on a rounded edge, and the direction of pull is loosely represented here by arrows.

In FIG. 9A, the invention in its preferred embodiment is shown being used to pop a line on a sheet of material at an angle other than ninety degrees off the edge of the sheet. To do this the user first grasps pull tab 26 between the thumb and finger of one hand, and grasps pull tab 28 in the same manner with his other hand. The user then rotates blade 14 out from main body 10 by pulling tabs 26 and 28 apart from each other as far as possible. Any of the alternative embodiments of the means for grasping on main body 10 and blade 14, suggested previously in this text and illustrated in FIG. 7C, can be similarly employed. Next, he rotates the entire chalk line end from its position of normal use (see FIG. 8A), and hooks the invention onto the edge of the sheet by means of blade 14. After this, the user pulls firmly straight back from the edge on chalk line 24, if necessary, to help blade edge 30 engage the edge of the material. Now he is ready and able to pop a line at most any angle off the edge of the sheet he chooses.

The same basic procedure can be applied if the only available edge for the chalk line end to be hooked to is rounded, tapered or otherwise imperfect, as is shown in FIG. 9A. This figure also illustrates the general direction of pull affecting the chalk line end when chalk line 24 is pulled taut, represented here, however inexactly, by arrows. This pull upward and helps blade edge 30 embed itself into the edge of the sheet, and supports the idea of a directionally toothed blade edge 30.

Additionally, the present invention is useful in this manner for popping lines on vertical surfaces with a suitable edge to engage. Also, if constant tension is kept on chalk line 24, blade 14 will hold fast to the edge when lines are popped over long distances.

CONCLUSION, RAMIFICATIONS, AND SCOPE

From the previous description it is evident that the invention, a modified chalk line end with retractable blade, can be used to pop lines at angles other than ninety degrees off the edge of a sheet of material, and function effectively even when the edge is rounded, tapered or otherwise awkward. In addition, it is useful in popping lines over considerable distances and on vertical surfaces with a defined edge, keeping the chalk line reliably on its mark.

Also, as they are constantly presented with new devices and methods of working, many of which represent a questionable "improvement" over prior art or method, tradesmen and women are generally reluctant to try new methods and tools unless they can clearly be proven to make a job or task significantly easier. The present invention supercedes this mentality in several ways. First and foremost, it is very similar in appearance to the standard chalk line end and can be used as such. Also, it is a real time-saver, and it solves significant problems that have bothered carpenters and tradespeople for years, simply and effectively.

In addition, one must consider the fact that the invention's value is in its novelty rather the value of the sum of its parts. A chalk line end of this type should not be overly difficult or expensive to manufacture, nor should it need to be formed by any overly expensive or exotic materials, making it a sound and profitable venture. In looking at the present invention from an investment standpoint, one must also realize that this product creates its own new niche in the market of hand tools. It is certainly complex enough to justify selling it independently from the rest of the chalk line system, at a cost much greater than what small portion the standard chalk line end must comprise of the price of the whole system. This is significant; It would mark the first time to this inventor's knowledge that chalk line ends are made available on their own, sold independently of the rest of the system. For the time being, tradespeople have to purchase the entire chalk line system if they lose only the chalk line end, as happens frequently when the string line is pulled on too hard and broken. While chalk box systems are not that expensive, once several complete systems have been purchased just to replace these small metal hooks, one begins to wonder why they aren't sold separately. In addition, chalk line ends of the present invention would have to endure serious wear and tear during everyday use, perhaps making it necessary to sell them in packs of more than one. Both of these factors present distributors with unique approaches to marketing the present invention, approaches not previously utilized to distribute products of this type.

In conclusion, although the description above contains many specificities, these should not be construed as limiting the scope of the invention, but as merely providing for a thorough explanation of the presently preferred embodiments of this invention. Size and shape are purposely expressed in vague terms, and some features are treated as optional or subject to change.

Thus the scope of the invention should be determined by the appended claims and their legal equivalents, rather than by the examples given.

What is claimed is:

1. A chalk line end, comprising:

a main body comprised of two flat members situated parallel to one another at a slight distance from each other, bent and fused together along at least one of their corresponding edges, each of said flat members containing towards one end a first aperture which a chalk line may be tied through; a section of at least one of said flat members at the opposite end from said aperture, bent at least once to form a main tab essentially perpendicular to said main body;

a blade loosely sandwiched between said flat members of said main body, the sharp edge of said blade adjacent to the long fused section of said flat members;

said blade coupled pivotally to said main body towards one end, allowing said blade to rotate out from said main body through a non-fused section of said flat members, until it is stopped when the blade edge is at an approximate ninety-degree angle to said main body by a means of stoppage located on said main body;

said blade containing a first means for grasping between thumb and finger on the exposed edge of said blade at the opposite end from the pivotal connection.

2. The chalk line end of claim 1, further including:

a second aperture in each of said flat members, and a third aperture in said blade similar to said second aperture;

said second and third apertures substantially aligning when said blade is drawn completely into said main body.

3. The chalk line end of claim 2, wherein said second and third apertures are essentially tear-shaped.

4. The chalk line end of claim 1, further including:

a second aperture in each of said flat members;

said blade being shaped in such a way that it clears said second aperture when is rotated at least partly out from said main body.

5. The chalk line end of claim 4, further including:

a means for automatically retracting said blade into said main body and holding said blade therein, located around the pivotal connection, and;

a catch for grabbing and holding said blade at a point in which said blade clears said second aperture.

6. The chalk line end of claim 5, wherein said means for automatically retracting said blade into said main body and holding said blade therein is comprised of:

a torsion spring centered around said pivotal connection, and coupled at one end to said main body and at the other end to said blade in such a way that the spring is under the most stress when said blade is rotated to the fullest extent possible from said main body;

said torsion spring possessing enough torque at this point to draw said blade completely into said main body and hold said blade therein.

7. The chalk line end of claim 1, further including:

a second means for grasping between thumb and finger, located on said main body at an opposing point from said first means for grasping between thumb and finger on said blade.

8. The chalk line end of claim 1, wherein said blade edge is comprised of a plurality of substantially triangular teeth.

9. The chalk line end of claim 8, wherein the teeth are directional, pointing in the general direction of the main body when the blade is rotated out to the furthest extent possible from said main body.

10. The chalk line end of claim 1, further including:

a torsion spring centered around said pivotal connection, and coupled at one end to said main body and at the other end to said blade in such a way that the spring is under the most stress when said blade is rotated completely out from said main body;

said torsion spring possessing enough torque at this point to draw said blade completely into said main body and hold said blade therein.

11. A chalk line end, comprising:

a main body comprised of two flat members situated parallel to one another at a slight distance from each other, bent and fused together along at least one of their corresponding edges, each of said flat members containing a large aperture, and also towards one end a smaller aperture which a chalk line may be tied through;

a section of at least one of said flat members bent at least once at the opposite end from said smaller aperture creating a main tab essentially perpendicular to said main body;

a blade loosely sandwiched between said flat members of said main body, the sharp edge of said blade adjacent to the long fused section of said flat members;

said blade coupled pivotally to said main body towards one end, allowing said blade to rotate out from said main body through a non-fused section of said flat members, until it is stopped when the blade edge is at an approximate ninety-degree angle to said main body by a means of stoppage;

said blade containing an aperture of similar size and shape as said large aperture in said flat members, these apertures substantially aligning when said blade is fully retracted into said main body;

said blade also having a first means of grasping between thumb and finger on the exposed edge of said blade at the opposite end from the pivotal connection.

12. The chalk line end of claim 11, further including:

a second means for grasping between thumb and finger located on said main body at an opposing point from said first means for grasping between thumb and finger of said blade.

13. The chalk line end of claim 11, further including:

a torsion spring centered around said pivotal connection, and coupled at one end to said main body and at the other end to said blade in such a way that the spring is under the most stress when said blade is rotated out to the fullest extent possible from said main body;

said torsion spring possessing enough torque at this point to draw said blade completely into said main body and hold said blade therein.

14. The chalk line end of claim 11, wherein said blade edge is comprised of a plurality of essentially triangular teeth.

15. The chalk line end of claim 14, wherein the teeth are directional, pointing in the general direction of the main body when the blade is rotated out to the furthest extent possible from said main body.

16. The chalk line end of claim 11, wherein said large aperture of said main body and said blade is essentially tear-shaped.

17. A chalk line end, comprising:

a main body consisting of two flat members situated parallel to one another at a slight distance from each other, bent and fused together along at least one of their corresponding edges, each of said flat members containing a large aperture, and also towards one end a smaller aperture which a chalk line may be tied through;

a section of at least one of said flat members bent at least once at the opposite end from said smaller aperture creating a main tab essentially perpendicular to said main body;

a blade loosely sandwiched between said members of said main body, the sharp edge of said blade adjacent to the long fused section of said flat members;

said blade coupled pivotally to said main body towards one end, allowing said blade to rotate out from said main body through a non-fused section of said flat members, until it is stopped when the blade edge is at an approximate ninety-degree angle to said main body by a means of stoppage;

said blade containing an aperture of similar size and shape as said large aperture in said flat members, these apertures substantially aligning when said blade is fully retracted into said main body;

said blade also containing a first means of grasping between thumb and finger on the exposed edge of said blade at the opposite end from the pivotal connection;

a means for automatically retracting said blade into said main body and holding said blade therein, located around said pivotal connection.

18. The chalk line end of claim 17, further including:

a second means of grasping between thumb and finger, located on said main body at an opposing point from said first means for grasping between thumb and finger on said blade.

19. The chalk line end of claim 17, wherein said means for automatically retracting said blade into said main body and holding said blade therein is comprised of a torsion spring centered around said pivotal connection, and coupled at one end to said main body and at the other end to said blade in such a way that the spring is under the most stress when said blade is rotated to the fullest extent possible out of said main body;

said torsion spring possessing enough torque at this point to draw said blade completely into said main body and hold said blade therein.

20. The chalk line end of claim 17, wherein the blade edge is comprised of a plurality of substantially triangular teeth.

21. The chalk line end of claim 20, wherein the teeth are directional, pointing in the general direction of the main body when the blade is rotated out to the furthest extent possible from said main body.

22. The chalk line end of claim 17, wherein said large aperture of said main body and said blade is essentially tear-shaped.

* * * * *